US005664733A

United States Patent [19]

Lott

[11] Patent Number: 5,664,733

[45] Date of Patent: Sep. 9, 1997

[54] FLUID MIXING NOZZLE AND METHOD

[76] Inventor: W. Gerald Lott, 6827 Signat Dr., Houston, Tex. 77041

[21] Appl. No.: 522,515

[22] Filed: Sep. 1, 1995

[51] Int. Cl.[6] ..... B05B 7/06

[52] U.S. Cl. ..... 239/429; 239/590.5; 239/601

[58] Field of Search ..... 239/398, 429, 239/433, 434, 589, 590, 590.5, 592, 594, 597, 598, 599, 601

[56] References Cited

U.S. PATENT DOCUMENTS

| | | | |
|---|---|---|---|
| 1,968,348 | 7/1934 | Placide | 239/590.5 |
| 2,638,976 | 5/1953 | Vixler | 239/601 |
| 3,123,285 | 3/1964 | Lee | 230/133 |
| 3,525,474 | 8/1970 | Von Ohain et al. | 239/265.17 |
| 3,701,482 | 10/1972 | Sachnik | 239/590.3 |
| 4,285,705 | 8/1981 | Niemann | 55/277 |
| 4,519,423 | 5/1985 | Ho et al. | 137/888 |
| 4,940,392 | 7/1990 | Adkins | 417/151 |
| 4,957,242 | 9/1990 | Schadow t al. | 239/590 |
| 4,971,768 | 11/1990 | Ealba et al. | 422/176 |
| 5,054,688 | 10/1991 | Grindley | 239/407 |
| 5,129,582 | 7/1992 | Rieke et al. | 239/601 |
| 5,403,522 | 4/1995 | Von Berg | 261/36.1 |

*Primary Examiner*—Andres Kashnikow
*Assistant Examiner*—Lisa Ann Douglas
*Attorney, Agent, or Firm*—Keeling Law Firm

[57] ABSTRACT

An improved fluid mixing nozzle and method, in which a first fluid flows therefrom to mix with a second fluid external the nozzle, for inducing vortex creation and chaotic turbulent flow. The nozzle has a body with a cavity extending therethrough from the inlet end to the outlet end. The cross sectional area of the inlet orifice of the nozzle is greater than its outlet orifice cross sectional area. The outlet orifice cross section area shape has a substantially circular central portion and at least one (but typically more than one) protrusion extending from the perimeter of the central portion. Generally, the protrusions are smaller in cross sectional area than the central portion, are equally spaced about the central portion perimeter, and have a length to width ratio from 1 to 2. Functionally applying the above described nozzle is a method of improved mixing, of creating chaotic turbulent flow, and of inducing vortex creation.

22 Claims, 4 Drawing Sheets

FLUID MIXING NOZZLE AND METHOD

BACKGROUND OF THE INVENTION

FIELD OF THE INVENTION

This invention relates to a nozzle and method. More specifically, it is directed to an improved fluid mixing nozzle that creates chaotic turbulent flow and induces vortices to form in the flow, thereby, transferring energy and velocity from the flow core to the boundary.

Efficient mixing of fluids is crucial for many devices and processes. For example, eductors, or jet pumps, accomplish mixing by contacting an accelerated jet of one fluid with a relatively stationary second fluid. Flow instabilities at the first fluid's boundary layer as well as the reduced pressure within the accelerated fluid causes entrainment of the second fluid.

Prior efforts of improving the mixing include distorting the edge of the nozzle outlet to produce eddies within the flow. The results achieved with the distortions, however, have been relatively ineffective. A second method of increasing the mixing effect includes pulsating the velocity or pressure of the first fluid. However, pulsating the velocity consumes external energy and, therefore, is often inefficient. A third method of enhancing the mixing effect is vortex induction in the jet flow (see U.S. Pat. No 4,519,423 that issued to Ho et al. on May 28, 1985). The swirling vortex promotes both bulk mixing and molecular dispersion.

Eductors often include a diffuser positioned downstream of the nozzle for pressure recovery. Without a diffuser, the flow energy dissipates rapidly. Typical diffusers have an inlet cross sectional area that is less than the outlet cross sectional area. Generally, a diffuser is a flow passage device for reducing the velocity and increasing the static pressure of a fluid. Therefore, the pressure gradient of the fluid opposes the flow. As a consequence, if the walls of the diffuser are too steep, the boundary layer may decelerate and thicken causing boundary layer separation. The separation wherein the flow velocity of the fluid cannot overcome the back pressure, may result in a reverse flow of fluid near the diffuser wall. Diffuser wall separation causes inefficient pressure recovery and inefficient velocity reduction.

One method of preventing diffuser wall separation includes using relatively long diffusers with a small taper angle. However, space or weight limitations may prevent the use of a long diffuser. A second method to prevent diffuser wall separation is to energize the boundary layer by maintaining the energy near the diffuser wall.

Techniques of energizing the boundary wall include active methods and passive methods. An example of an active method is injection of additional fluid near the diffuser wall where stall is likely to occur. In general, passive methods involve transferring energy from the flow core, which has a relatively higher velocity than the boundary portions, to the boundary portions.

In other words, the flow at any particular point in the diffuser has a kinetic energy flux profile. For example, in a typical diffuser, the axial portion has a greater velocity than the boundary portion. Thus, the flux profile is peaked. However, a uniform exit flow profile provides greater pressure recovery; and the maximum pressure recovery is achieved with a peaked inlet profile and a uniform outlet profile. Consequently, transferring energy and velocity from the flow core to boundary portions results in greater pressure recovery.

An effective manner of accomplishing the passive transfer of energy to the boundary portions includes creating vortices within the flow as shown in U.S. Pat. No. 4,971,768 that issued to Ealba et al. on Nov. 20, 1990, U.S. Pat. No. 4,957,242 that issued to Schadow on Sep. 18, 1990, and Ho et al. Generally, Ealba et al. discloses vortex creation using a thin convoluted wall member positioned downstream of the nozzle; Schadow shows vortex creation using a nozzle having an elongated outlet that produces a swirling of the exiting fluid; and Ho et al. reveals vortex creation using a noncircular outlet having unequal major and minor axes, with the major axis to minor axis ratio less than five.

Though the above mentioned nozzles and mixing devices may be helpful in mixing, enhanced entrainment of a secondary fluid, and pressure recovery, they can be improved to provide greater mixing efficiency, greater pressure recovery, higher entrainment vacuum, and to allow for the use of relatively shorter diffusers, thereby, reducing cost and energy consumption. None of the references show creation of a chaotic turbulence and wide scale vortex induction to improve mixing and pressure recovery.

SUMMARY OF THE INVENTION

Accordingly, the objectives of this invention are to provide, inter alia, an improved fluid mixing nozzle that:

- accelerates a fluid;
- provides improved mixing of fluids, including both bulk mixing and molecular dispersion;
- facilitates the use of shorter diffusers in eductors;
- permits the use of diffusers having a taper angle up to 35 degrees;
- creates a chaotic turbulent flow;
- induces vortices to form in the flow;
- transfers energy and velocity from the flow core to the boundary layer and, thereby, energizes the boundary layer;
- improves entrainment in eductors;
- permits convergence of resulting independent flows at a predetermined point downstream of the nozzle;
- generates a substantially uniform exit flow profile from a diffuser; and
- when used in an eductor, obtains a pressure recovery of at least 80 percent.

To achieve such improvements, my invention is an improved fluid mixing nozzle in which a first fluid flows therefrom to mix with a second fluid external the nozzle. The nozzle has a nozzle body with a cavity extending therethrough. The cavity defines an inlet orifice in the inlet end of the nozzle and an outlet orifice in the outlet end of the orifice. The cross sectional area of the inlet orifice is greater than the cross sectional area of the outlet orifice. The outlet orifice cross sectional shape has a substantially circular central portion and at least one protrusion extending from the perimeter of the central portion. Preferably, the cross sectional shape includes a plurality of protrusions extending from the central portion.

BRIEF DESCRIPTION OF THE DRAWING

The manner in which these objectives and other desirable characteristics can be obtained is explained in the following description and attached drawings in which.

DETAILED DESCRIPTION OF THE INVENTION

Figure 1:
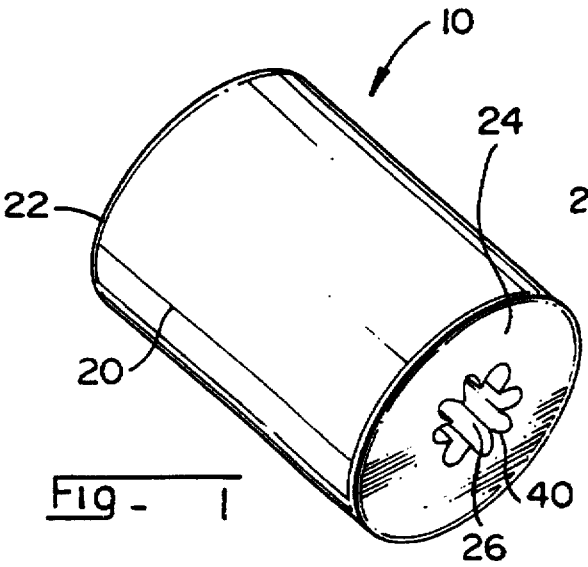
FIG. 1 is an isometric view of the fluid mixing nozzle.

The preferred embodiment of my invention is illustrated in FIGS. 1 through 8 and the improved fluid mixing nozzle is depicted as 10. Generally, the nozzle 10 comprises a nozzle body 26 20 an inlet orifice 30, an outlet orifice 40, and a cavity connecting the inlet orifice 30 and outlet orifice 40. The outlet orifice 30 is constructed to create a chaotic turbulent, accelerated flow therefrom.

The nozzle body 20 has a nozzle inlet end 22 and a nozzle outlet end 24. Typically, the nozzle body 20 is cylindrical to conform to standard pipe cavities.

The cavity 26 extends through the nozzle body 20 from the nozzle inlet end 22 to the nozzle outlet end 24. In a cylindrical nozzle body 20, the cavity 26 preferably extends axially therethrough. Where the cavity 26 intersects the nozzle inlet end 22, the cavity 26 defines a nozzle inlet orifice 30 that preferably has a circular cross-sectional shape. Likewise, where the cavity 26 intersects the nozzle outlet end 24, the cavity 26 defines a nozzle outlet orifice 40. To provide for acceleration of fluid through the nozzle 10, the nozzle inlet orifice 30 has a greater cross sectional area than the nozzle outlet orifice 40. Although the cavity 26 may have parallel walls, in the preferred embodiment, the cavity 26 is tapered to provide for a smooth transition between the nozzle inlet orifice 30 and the nozzle outlet orifice 40. The angle of convergence of the preferred taper is between 12 degrees and 45 degrees with optimum performance resulting from an angle of convergence between 30 degrees and 38 degrees.

The taper angle may provide for convergence of the flows from each of the protrusions 50, described below, at a predetermined point downstream of the nozzle outlet orifice 40. In other words, constructing the nozzle with a particular taper angle results in convergence, or intersection, of the flow at a predetermined point downstream of the nozzle 10. Therefore, if the taper angles for each of the protrusions 50 are equal, the flows from each of the protrusions 50 will converge at the same 50 point. However, the taper angles of each of the protrusions can be varied to cause the flows from each of the protrusions 50 to intersect the core at different points downstream of the nozzle 10. Consequently, depending upon the need for the particular system, the flows can be made to converge or not converge; or the nozzle 10 taper angle construction may permit convergence of some of the flows at one predetermined point and convergence of other flows at a separate predetermined point. An unlimited amount of variations and iterations of possible flow convergence and nonconvergence is possible and anticipated. Other protrusion 50 configurations can create other patterns of chaotic turbulence such as by alternating the radial sequence of the protrusions 50 in aspect ratios and degree of taper angle.

Figure 2:
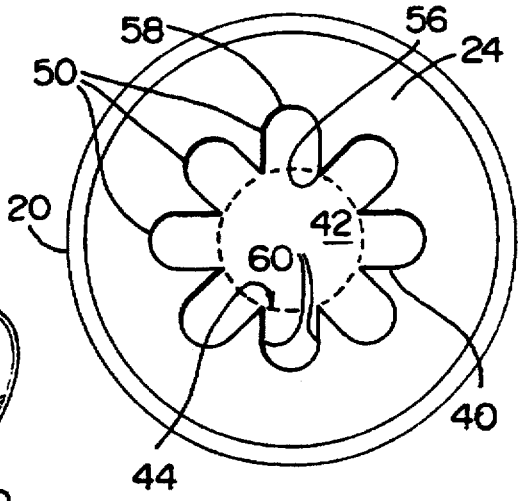
FIG. 2 is an outlet end elevational view of the nozzle, shown in FIG. 1, that has eight protuberances extending from the perimeter of the central portion of the outlet orifice cross sectional shape. The protuberances have similar shapes and cross sectional areas, a rounded protrusion apogee end, and a radial dimension to tangential dimension ratio of approximately 1:1.
Figure 3:
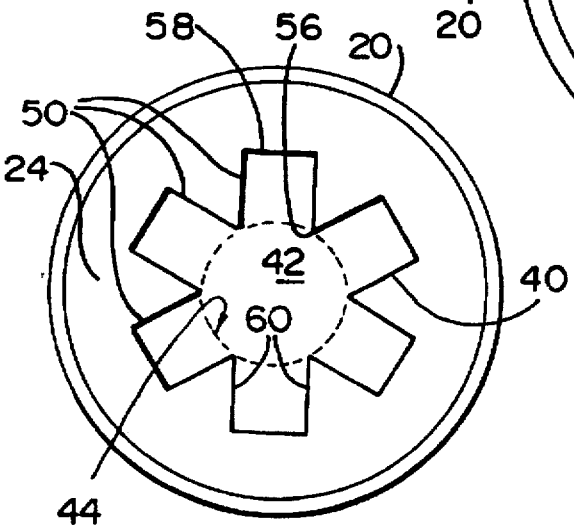
FIG. 3 is an outlet end elevational view of a nozzle that has six protuberances extending from the perimeter of the central portion of the outlet orifice cross sectional shape. The protuberances have similar shapes and cross sectional areas, a substantially flat protrusion apogee end, and a radial dimension to tangential dimension ratio of approximately 1:1.
Figure 4:
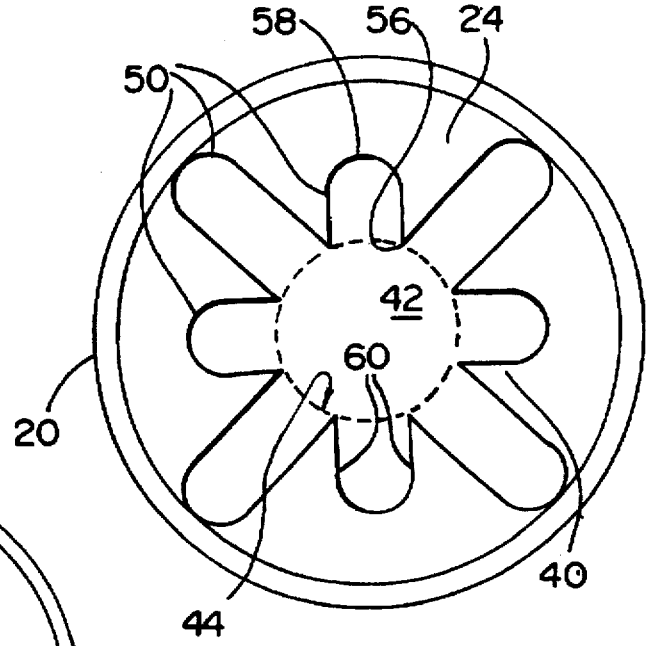
FIG. 4 is an outlet end elevational view of a nozzle that has eight protuberances extending from the perimeter of the central portion of the outlet orifice cross sectional shape. The radial dimension to tangential dimension ratios alternate between a ratio of approximately 1:1 and a ratio of approximately 2:1.
Figure 5:
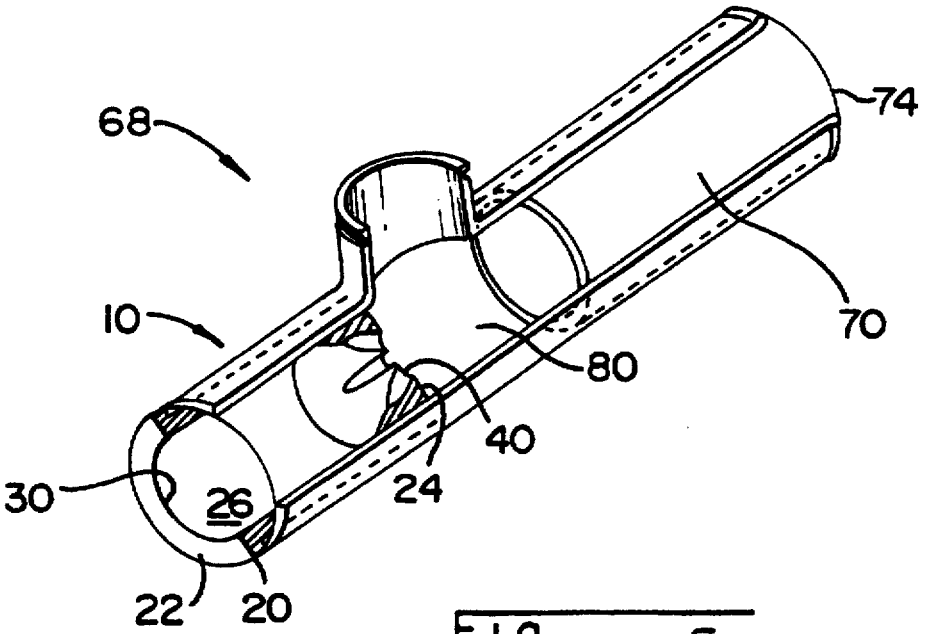
FIG. 5 is a partial cross sectional isometric view of an eductor that includes the nozzle.
Figure 6:
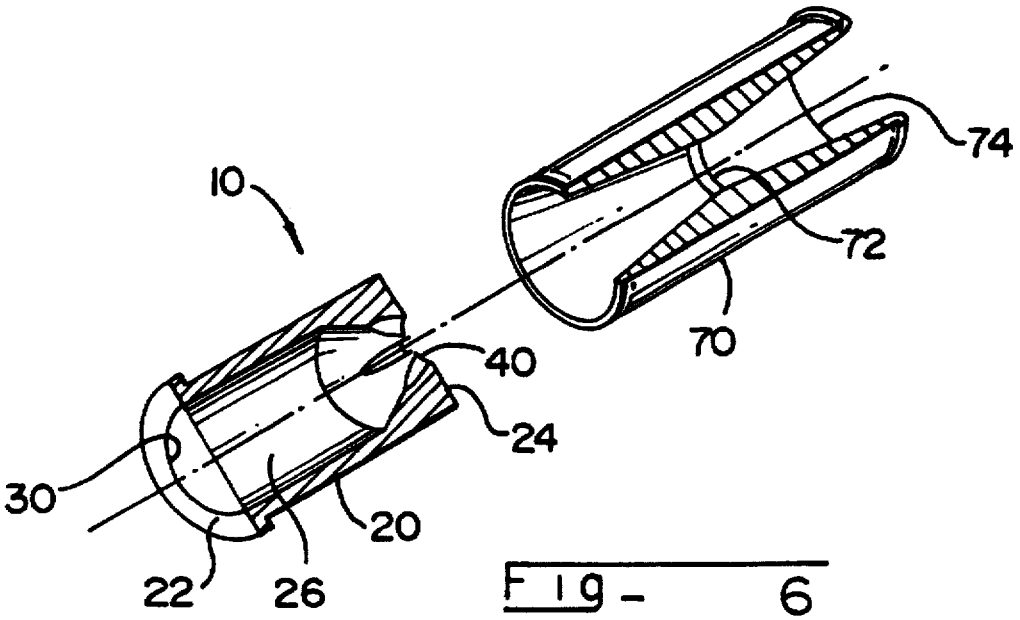
FIG. 6 is a partial cross sectional isometric view of the nozzle and diffuser of FIG. 5.

The nozzle outlet orifice 40 cross sectional shape has a substantially circular central portion 42 and at least one protrusion 50 extending from the perimeter 44 of the central portion 42. Each protrusion 50 has a length, or radial dimension, measured in a radial direction of said central portion, and a width, or tangential dimension, measured in a direction perpendicular to said radial dimension. The end of each protrusion 50 that is proximal the central portion 42, the protrusion junction end 56, is open to the central portion 42 as shown in the figures. The end of each protrusion 50 that is distal the central portion 42 and the protrusion junction end 56 is the protrusion apogee end 58. The protrusion apogee end 58 is preferably either rounded, as shown in FIGS. 1, 2, and 4, or flat, as shown in FIG. 3.

Each protrusion 50 commonly has linear opposing sides 60 that extend from the protrusion junction end 56 to the protrusion apogee end 58. Preferably, the sides 60 are either parallel or converge at a predetermined angle from a maximum width at the protrusion junction end 56 to a minimum width at the protrusion apogee end 58.

Typically, the nozzle outlet orifice 40 cross sectional 50 shape has a plurality of protrusions 50. These protrusions are generally equally spaced about the perimeter 44 of the central portion 42, but may alternatively be unequally spaced. FIGS. 1, 2, and 4 show a nozzle outlet orifice 40 cross sectional shape that=has eight equally spaced protrusions 50. FIG. 3 shows a nozzle outlet orifice 40 cross sectional shape that has six equally spaced protrusions 50.

Generally, each protrusion 50 is relatively smaller than the central portion 42. The dimensions and shape of each protrusion may take virtually any form. However, the preferred embodiments generally have a symmetrical configuration. For example, the nozzle outlet orifice 40 cross sectional shape shown in FIGS. 1 through 3 includes protrusions wherein the radial dimension and the tangential dimension of each protrusion 50 are substantially equal and the protrusions 50 have similar cross sectional shapes. Thus, the protrusions 50 shown in these figures have a ratio of the radial dimension to the tangential dimension of approximately 1:1.

The nozzle outlet orifice 40 cross sectional shape shown in FIG. 4 also includes protrusions that have generally a symmetrical configuration. However, the protrusions 50 have a ratio of the radial dimension to the tangential dimension that alternates between a ratio of approximately 1:1 and a ratio of approximately 2:1 for adjacent protrusions. Radial dimension to tangential dimension ratios, as shown in the figures, have been tested in the range of from 1:1 to 2:1 and have been shown beneficial. Although these ratios are disclosed in the drawings for reference purposes, the present invention encompasses ratios and configurations of all types capable of obtaining the objectives set forth above. As previously mentioned, other protrusion 50 configurations can create other patterns of chaotic turbulence such as by alternating the radial sequence of the protrusions 50 in aspect ratios and degree of taper angle.

Functionally applying the above described fluid mixing nozzle 10 provides a method for vortex induction and for creating chaotic turbulent flow. A method of improved mixing comprises the steps of providing a nozzle 10, similar to the one described above, that is capable of creating a chaotic turbulent, accelerated flow therefrom. A first fluid directed through and accelerated by the nozzle 10 contacts and mixes with a second fluid.

When the above described nozzle 10 is applied to an eductor 68, the mixing of the accelerated first fluid with the second fluid takes place immediately downstream of the nozzle 10 in the mixing area 80. The second fluid may be stationary relative to the accelerated first fluid or may flow into the contact with the first fluid by injection or other means. The mixed fluid may flow into a containment structure such as a diffuser 70 or an open container. Eductors 68 generally include a diffuser 70 for pressure recovery. The diffuser 70 has a diffuser inlet end 72 that has a smaller cross sectional area than the diffuser outlet end 74 and a smooth transitional taper.

Experiments to evaluate the performance of the above described nozzle 10 reveal that in use the nozzle 10 emits large scale vortices that transfer energy and velocity from the flow core to the boundary layer. The resulting flow pattern from the nozzle 10 includes a vortex from each protrusion 50. The nozzle 10 additionally provides a chaotic turbulent flow which permits the use of shorter diffusers 70 in an eductor 68. The chaotic turbulent flow and the vortices provide for enhanced mixing.

Figure 7:
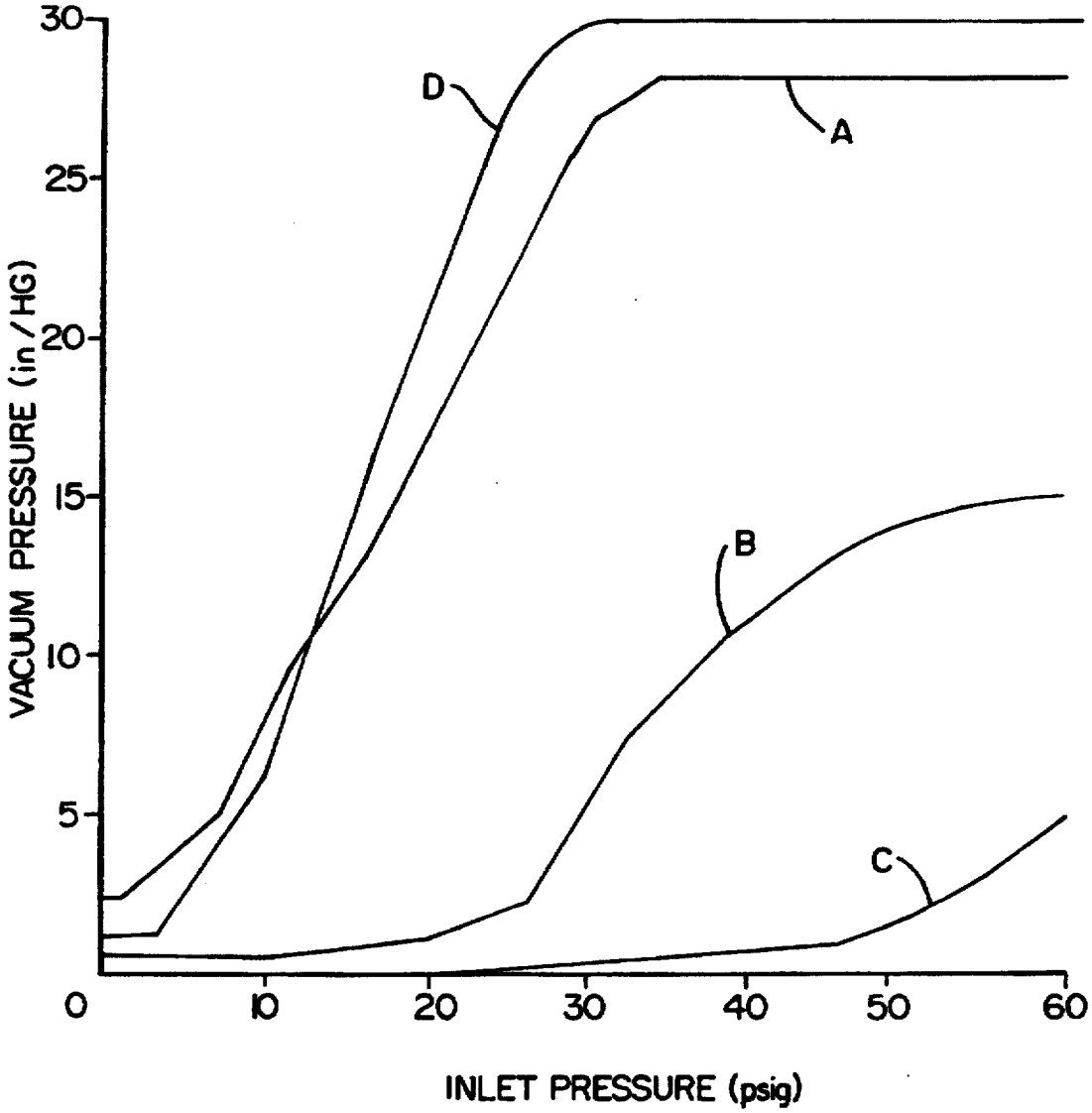
FIG. 7 is a plot of the inlet pressure to the nozzle, measured in psig, versus the vacuum pressure of the second fluid being drawn into the eductor, measured in inches of mercury, and illustrates the results of a comparative test in which a variety of nozzle outlet orifice configurations were functionally placed in an eductor having a diffuser.
Figure 7A:
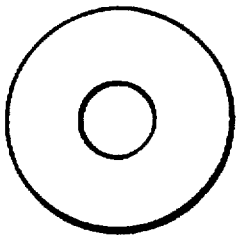
FIG. 7A is an outlet end elevational view of a nozzle that has a circular outlet.
Figure 7B:
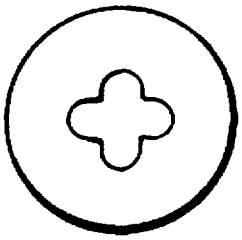
FIG. 7B is an outlet end elevational view of a nozzle that has a double elliptical outlet.
Figure 7C:
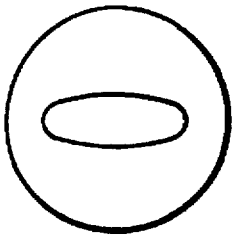
FIG. 7C is an outlet end elevational view of a nozzle that has an elliptical outlet.
Figure 8:
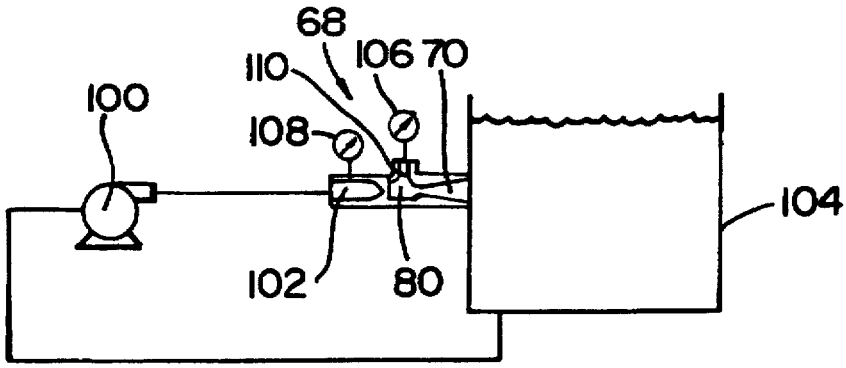
FIG. 8 is a schematic of the test apparatus used for comparative testing of the nozzle.

FIG. 7 illustrates the results of a comparative test in which a variety of nozzle outlet orifice configurations were functionally placed in an eductor 68 having a diffuser. The test apparatus, shown schematically in FIG. 8, included a centrifugal pump 100 in flow communication with the inlet chamber 102 of the eductor 68. From the inlet chamber 102, the fluid passed through the nozzle to the mixing area 80, through a diffuser 70, and into a relatively large tank 104. A vacuum pressure gage 106 in the second fluid supply inlet 110 provided measurement of the entrainment vacuum of the eductor 68. Greater entrainment vacuum results in greater entrainment of second fluid into the eductor 68. A second pressure gage 108 measured the pressure in the inlet chamber of the eductor 68 which is the pressure supplied to the eductor 68. The only portion of the eductor 68 that was changed in each test was the nozzle. Each of the tested nozzles had the same outlet orifice cross sectional area. The nozzle outlet orifices cross sectional shapes tested include a circular outlet (FIG. 7A), a double ellipse outlet (FIG. 7B), a single ellipse outlet (FIG. 7C), and the present invention outlet having a circular core and six similarly sized and shaped protrusions (FIG. 3) that adhered to the following:

$$r=2l=2w$$

where r is the radius of the circular core, l is the radial dimension of each protrusion, and w is the tangential dimension of each protrusion.

FIG. 7 plots the inlet pressure to the nozzle, measured in psig, versus the vacuum pressure applied to the second fluid supply inlet 110 of the eductor 68, measured in inches of mercury. In FIG. 7, the circular outlet, the double ellipse outlet, the single ellipse outlet, and the present invention outlet are indicated by lines A, B, C, and D respectively. As shown in this plot, the vacuum obtained with the nozzle 10 of the present invention is significantly greater than that of the other nozzle outlet configurations. Because of the positive correlation between higher vacuum and entrainment, this greater vacuum of the secondary fluid indicates that the eductor 68 is capable of mixing greater amounts of the second fluid with the first fluid and of achieving greater entrainment. During the tests, the pressure recovery of the nozzle 10 of the present invention was visually observed as greater than that of the other nozzle configurations.

I claim:

1. An improved fluid mixing nozzle in which a first fluid flows therefrom to mix with a second fluid external the nozzle, the nozzle comprising:

a nozzle body having a nozzle inlet end and a nozzle outlet end;

a cavity extending from said nozzle inlet end through said nozzle body to said nozzle outlet end;

said cavity defining a nozzle inlet orifice at said nozzle inlet end;

said cavity further defining a nozzle outlet orifice at said nozzle outlet end;

said nozzle outlet orifice cross sectional shape having a substantially circular central portion and at least three protrusions extending from a perimeter of said central portion;

each of said at least three protrusions having a radial dimension, measured in a radial direction of said portion, and a tangential dimension, measured in a direction perpendicular to said radial dimension;

each of said at least three protrusions having a protrusion junction end proximal said central portion and a protrusion apogee end distal said central portion;

said at least three protrusions equally spaced about the perimeter of said central portion;

each of said at least three protrusions being relatively smaller than said central portion;

said nozzle inlet orifice having a greater cross sectional area than said nozzle outlet orifice;

said cavity at least partially tapered and having a first fluid flowing therethrough;

said taper providing a smooth transition between said nozzle inlet orifice and said nozzle outlet orifice;

whereby the resultant flow pattern of said first fluid downstream of said nozzle outlet orifice includes a flow core and a vortex produced from each of said at least three protrusions; and whereby turbulent mixing of said first fluid and a second fluid external said nozzle is enhanced.

2. A nozzle as claimed in claim 1 wherein said nozzle body is substantially cylindrical.

3. A nozzle as claimed in claim 1 wherein said nozzle inlet orifice having cross sectional shape that is substantially circular.

4. A nozzle as claimed in claim 1 wherein the tangential dimension of each of said at least three protrusions at the protrusion junction end is relatively smaller than the diameter of said central portion.

5. A nozzle as claimed in claim 1 wherein the ratio of said radial dimension to said tangential dimension is 1.

6. A nozzle as claimed in claim 1 wherein the ratio of said radial dimension to said tangential dimension is 2.

7. A nozzle as claimed in claim 1 wherein:

each of said at least three protrusions having a pair of opposing sides extending between said protrusion junction end and said protrusion apogee end; and said opposing sides are substantially parallel.

8. A nozzle as claimed in claim 1 wherein:

each of said at least three protrusions having a pair of substantially linear opposing sides extending between said protrusion junction end and said protrusion apogee end; and said opposing sides converging at a predetermined angle.

9. A nozzle as claimed in claim 8 wherein said tangential dimension decreases from a maximum width at said protrusion junction end to a minimum width at said protrusion apogee end.

10. A nozzle as claimed in claim 1 wherein said protrusion apogee end is rounded.

11. A nozzle as claimed in claim 1 wherein said protrusion apogee end is substantially flat.

12. A nozzle as claimed in claim 1 wherein said the ratio of said radial dimension to said tangential dimension is less than 1.

13. A nozzle as claimed in claim 1 wherein: said radial dimensions and said tangential dimensions of said at least three protrusions are substantially equal; and said at least three protrusions having similar cross sectional shapes.

14. A nozzle as claimed in claim 1 wherein the ratio of said radial dimensions to said tangential dimensions is greater than 1.

15. A nozzle as claimed in claim 1 wherein the ratio of said radial dimension to said tangential dimension alternates between a ratio of approximately 1 and a ratio of approximately 2 for adjacent protrusions of said at least three protrusions.

16. A nozzle as claimed in claim 1 wherein said nozzle outlet orifice cross sectional shape has 6 protrusions.

17. A nozzle as claimed in claim 1 wherein said nozzle outlet orifice cross sectional shape has 8 protrusion.

18. A nozzle as claimed in claim 1 wherein said cavity is tapered to provide for a smooth transition between said nozzle inlet orifice and said nozzle outlet orifice.

19. A nozzle as claimed in claim 1 wherein said taper provides for convergence of the vortex induced flows from each of said at least three protrusions at a predetermined point downstream of said nozzle outlet orifice.

20. A method for vortex induction and for creating chaotic turbulent flow comprising functionally applying said nozzle according to claim 1.

21. An improved fluid mixing nozzle in which a first fluid flows therefrom to mix a second fluid external the nozzle, the nozzle comprising:

a nozzle body having a nozzle inlet end and a nozzle outlet end;

a cavity extending from said nozzle inlet end through said nozzle body to said nozzle outlet end;

said cavity defining a substantially circular nozzle inlet orifice at said nozzle inlet end;

said cavity further defining a nozzle outlet orifice at said nozzle outlet end;

said nozzle outlet orifice cross sectional shape having a substantially circular central portion and at least three protrusions extending from a perimeter of said central portion;

each of said at least three protrusions having a radial dimension, measured in a radial direction of said central portion, and a tangential dimension, measured in a direction perpendicular to said radial dimension;

each of said at least three protrusions having a protrusion junction end proximal said central portion and a protrusion apogee end distal said central portion;

each of said at least three protrusions being equally spaced about said perimeter of said central portion;

each of said at least three protrusions having a ratio of said radial dimension to said tangential dimension that is equal to 1;

each of said at least three protrusions having similar cross sectional shapes and areas;

each of said at least three protrusions being relatively smaller than said central portion;

said nozzle inlet orifice having a greater cross sectional area than said nozzle outlet orifice;

said cavity at least partially tapered and having a first fluid flowing therethrough;

said taper providing a smooth transition between said nozzle inlet orifice and said nozzle outlet orifice;

whereby the resultant flow pattern of said first fluid downstream of said nozzle outlet orifice includes a flow core and a vortex produced from each of said at least three protrusions; and whereby turbulent mixing of said first fluid and a second fluid external said nozzle is enhanced.

22. A method for vortex induction and for creating chaotic turbulent flow comprising functionally applying said nozzle according to claim 21.

* * * * *